US008644958B2

(12) United States Patent
Morelli et al.

(10) Patent No.: US 8,644,958 B2
(45) Date of Patent: Feb. 4, 2014

(54) METHOD AND SYSTEM FOR THE PROTECTION OF AN ELECTRIC LINE FOR RAILWAY SIGNALS

(75) Inventors: Maurizio Morelli, Genoa (IT); Daniele Trentini, Chiavari (IT)

(73) Assignee: Sirti S.p.A., Milan (IT)

( * ) Notice: Subject to any disclaimer, the term of this patent is extended or adjusted under 35 U.S.C. 154(b) by 360 days.

(21) Appl. No.: 12/998,670

(22) PCT Filed: Nov. 18, 2009

(86) PCT No.: PCT/IB2009/007508

§ 371 (c)(1),
(2), (4) Date: Aug. 2, 2011

(87) PCT Pub. No.: WO2010/058271

PCT Pub. Date: May 27, 2010

(65) Prior Publication Data

US 2011/0288657 A1 Nov. 24, 2011

(30) Foreign Application Priority Data

Nov. 21, 2008 (IT) ..... MI2008A2088

(51) Int. Cl.
*G05B 11/01* (2006.01)

(52) U.S. Cl.
USPC ..... 700/8; 710/301

(58) Field of Classification Search
USPC ..... 700/8; 710/301
See application file for complete search history.

(56) References Cited

U.S. PATENT DOCUMENTS

| | | | | |
|---|---|---|---|---|
| 5,644,730 | A * | 7/1997 | Fayfield | 710/301 |
| 6,098,140 | A * | 8/2000 | Pecone et al. | 710/311 |
| 6,496,892 | B1 * | 12/2002 | Lake et al. | 710/301 |
| 6,640,276 | B2 * | 10/2003 | Flaschka et al. | 710/305 |
| 2002/0046290 | A1 * | 4/2002 | Andersson et al. | 709/237 |
| 2004/0117535 | A1 * | 6/2004 | Schaftlein et al. | 710/301 |
| 2005/0228507 | A1 * | 10/2005 | Dachs et al. | 700/1 |
| 2006/0143493 | A1 * | 6/2006 | Meis et al. | 714/4 |
| 2008/0007772 | A1 * | 1/2008 | Birkenfeld et al. | 358/1.15 |
| 2008/0260097 | A1 * | 10/2008 | Anwar et al. | 378/57 |
| 2009/0164031 | A1 * | 6/2009 | Johnson et al. | 700/89 |

FOREIGN PATENT DOCUMENTS

| | | | |
|---|---|---|---|
| DD | 261 343 | A1 | 10/1988 |
| JP | 11 119803 | A | 4/1999 |
| JP | 2000-035801 | A | 2/2000 |

OTHER PUBLICATIONS

International Search Report Dated Jun. 7, 2011.

* cited by examiner

*Primary Examiner* — Mohammad Ali
*Assistant Examiner* — Anthony Whittington
(74) *Attorney, Agent, or Firm* — Hedman & Costigan, P.C.; James V. Costigan; Kathleen A. Costigan

(57) ABSTRACT

A system for the protection of an electric line for railway signals that comprises a computerized central apparatus (ACC) connected to a plurality of peripheral posts (PP). Each peripheral post comprises at least one plant-controller electronic card (CdE), which controls a plurality of plant-interface cards (IE) that supply the plants (E) directly, via a field bus (B1), on the basis of the commands received from the plant controller and acquire the control signals from the field sensors, transferring them to the controller.

3 Claims, 2 Drawing Sheets

METHOD AND SYSTEM FOR THE PROTECTION OF AN ELECTRIC LINE FOR RAILWAY SIGNALS

The present invention relates to a method and a system for protection of an electric line for railway signals. For the purposes of the present invention an electric line for signals of a railway type comprises a computerized central apparatus (ACC) that manages a plurality of peripheral posts, by sending to them the railway logic commands. Each peripheral post executes said commands in field and transmits the corresponding controls acquired from the field plants.

Each peripheral post comprises at least one plant controller (CdE), which controls a plurality of plant-interface (IE) cards.

Said interface or driving cards have the task of supplying the plants (E) directly on the basis of the commands received from the controller and acquiring the control signals from the field sensors, transferring them to the controller. Examples of plants of the line are track circuits or light-signalling devices (semaphores).

The interface or driving cards are the sensitive elements of the line and those for which operating faults are frequent.

Normally, in response to occurrence of a fault, for the stretch of railway line affected, the procedure is to set the stretch in safety conditions, i.e., all the trains affected by the fault are warned and intervention is undertaken to remedy the fault, for example via replacement of an electronic card.

During said period, clearly the stretch of line will function at a reduced capacity; for example, the trains may be forced to proceed by sight, or it may even be necessary to interrupt the traffic on that stretch of line.

The present invention proposes overcoming the aforesaid drawbacks by providing an apparatus for protection of the line that comprises at least one backup interface card, which is automatically connected instead of the card in which the fault has occurred for the time necessary for repairing said card.

One aspect of the present invention regards a system for the protection of an electric line for railway signals having the characteristics specified in claim 1 attached hereto.

A further aspect of the present invention regards a method for the protection of an electric line for railway signals having the characteristics specified in claim 3 attached hereto.

Figure 1:
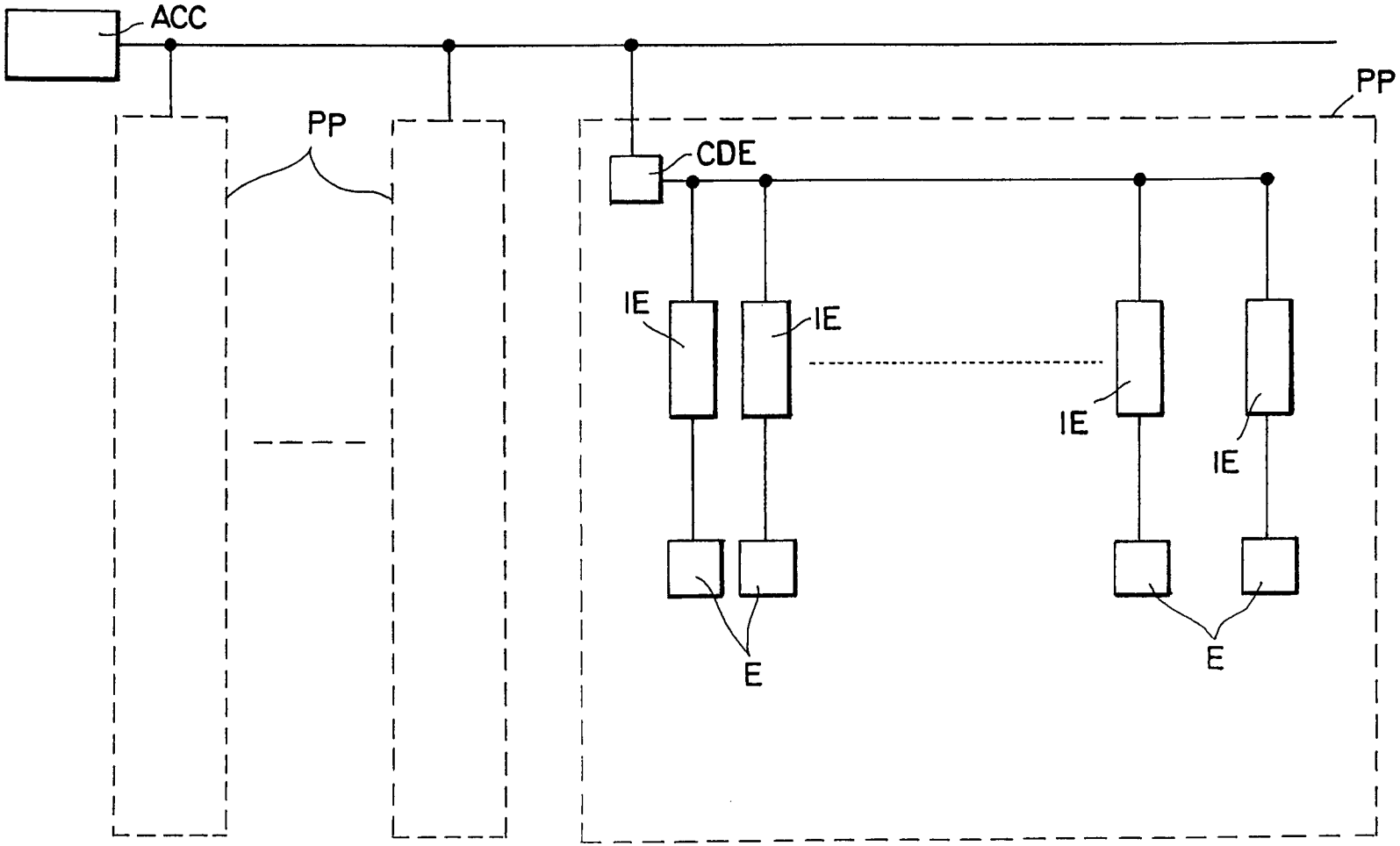
Figure 2A:
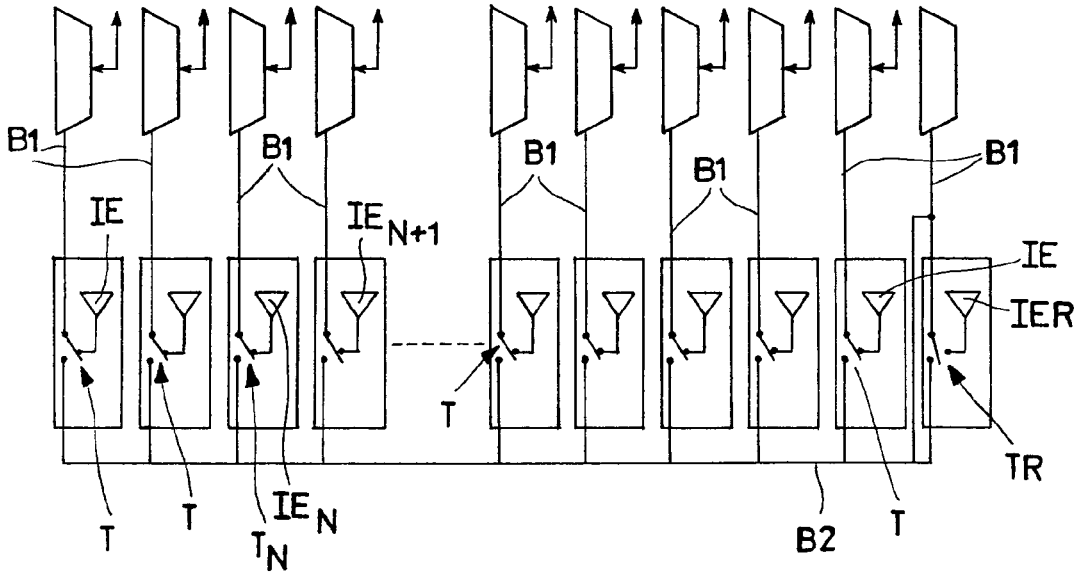
Figure 2B:
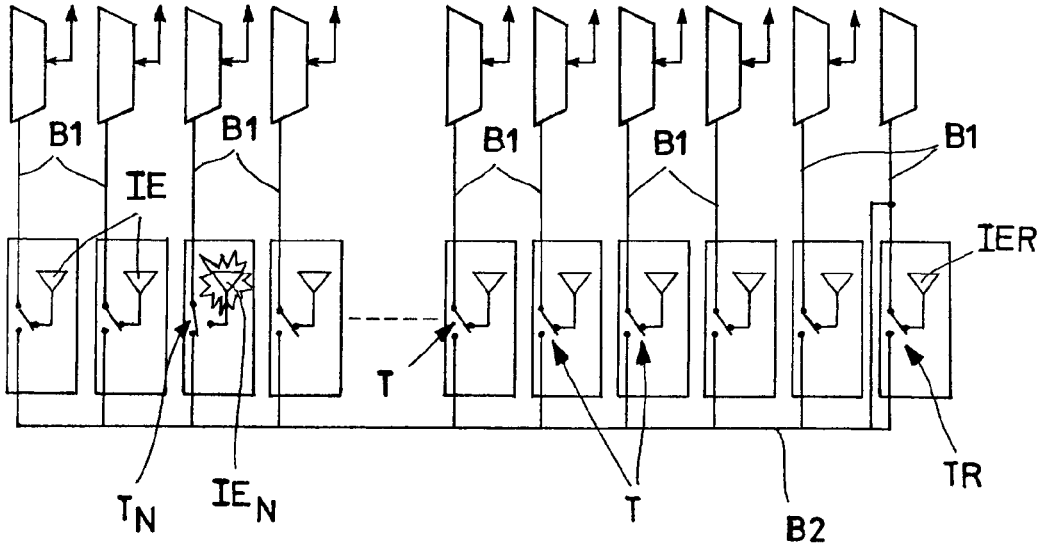

The characteristics and advantages of the method and system according to the present invention will emerge more clearly from the ensuing description, provided by way of non-limiting example of one embodiment thereof with reference to the attached figures, in which:

FIG. 1 represents a block diagram of a railway line according to the present invention;

FIGS. 2*a* and 2*b* represent the system according to the present invention respectively in conditions of normal operation and in conditions of breakdown following upon triggering of the protection procedure.

With reference to the aforesaid figures, the system according to the present invention comprises a computerized central apparatus ACC that manages a plurality of peripheral posts PP, sending to them the railway logic commands. Each peripheral post implements said commands in field and transmits the corresponding controls acquired from the field plants.

Each peripheral post comprises at least one plant controller CdE, which controls a plurality of plant-interface cards IE.

Said interface or driving cards have the task of supplying the plants E directly on the basis of the commands received from the controller and acquiring the control signals from the field sensors, transferring them to the controller. Examples of plants of the line are track circuits, light-signalling devices (semaphores), vital inputs/outputs (control and reading of railway relays), drive boxes (railway points), etc. The plant-interface cards IdE are normally located in an appropriate area of the peripheral post PP.

Each card comprises a connection bus B1 for a respective connector, designed to connect the interface card with the controlled plant. Terminated on said connector are the connection cables to the railway-yard plants.

Each peripheral post also comprises a switching relay T for each interface card, which is controlled by the plant controller CdE and enables selective connection of the interface card, via the field bus B1, to the plant or to a protection bus B2, which connects up to all the plant-interface cards IE.

The interface cards in normal operating conditions have their protection relays in a position such as to connect the analog outputs/inputs on their own field bus and hence control correctly their own plant.

According to the present invention, inserted within each peripheral post associated to the plant controller is a backup plant-interface card IER connected to the common protection bus B2 via a switching relay TR, also controlled by the plant interface, which in the case of a failure to one of the active interface cards replaces said failed card automatically via switching of said relays.

In the case where the plant controller CdE detects a fault of a given N-th interface card $IE_N$, it governs the protection relay $T_N$ of the failed card in such a way that the card will be disconnected from the controlled plant and will instead be connected to the common protection bus B2. The controller moreover controls the switching relay TR of the backup card IER so as to connect its own field bus B1R to the inputs and outputs of the plant that was controlled by the failed card. The controller at this point is able to control and program the backup card with the same programmings (or settings) that were those of the failed card.

Clearly, the protection or backup cards can be in a number higher than one in so far as, with the same method according to the present invention, it is possible to protect different types of cards IdE within the same rack of the peripheral post PP (in this case, once the first failure of the card IE has occurred and the subsequent automatic replacement thereof has been made, it is no longer possible to replace further failed cards IE automatically in so far as the protection bus B2 is already occupied with replacement of the first failed card IE).

Barzanò & Zanardo Milano S.p.A.

The invention claimed is:

1. A system for protecting an electric line for railway signals, said line comprising:

a computerized central apparatus (ACC) connected to a plurality of peripheral posts (PP), each peripheral post comprising at least one plant-controller electronic card (CdE), which controls a plurality of plant-interface cards (IE) that supply the plants (E) directly, via a field bus (B1), on the basis of the commands received from the plant controller and acquire the control signals from the field sensors, transferring them to the controller, said system being characterized in that it comprises:

a protection bus (B2) common to all the interface cards;

a switching relay (T) for each interface card, controlled by the plant-controller card (CdE), which enables selective connection of its own interface card, via the field bus (B1), with the plant (E) or with the protection bus (B2);

at least one backup interface card (IER) connected to the common protection bus (B2) via a switching relay (TR), which is also controlled by the plant interface, which, in the case of a failure to one of the active interface cards, replaces said failed card automatically via switching of said relays.

2. The system according to claim 1, wherein said plants of the line are track circuits, light-signalling devices, vital inputs/outputs) drive boxes, etc.

3. A method for the protection of an electric line for railway signals, said line comprising:

a computerized central apparatus (ACC) connected to a plurality of peripheral posts (PP);

each peripheral post comprising at least one plant-controller electronic card (CdE), which controls a plurality of plant-interface cards (IE) that supply the plants (E) directly via a field bus (B1), on the basis of the commands received from the plant-controller card and acquire the control signals from the field sensors, transferring them to the controller, said method being characterized in that the plant controller carries out the following steps:

identifying the failed interface card;

disconnecting the failed card from the controlled plant (E) and connecting the corresponding connector to a protection bus;

connecting the outputs/inputs of a backup interface card to the plant controlled via the protection bus; and programming said backup card with the same settings as those possessed by the failed card.

* * * * *